US009289084B1

(12) United States Patent
McKeown

(10) Patent No.: US 9,289,084 B1
(45) Date of Patent: Mar. 22, 2016

(54) ZIPPER ASSIST DEVICE

(71) Applicant: Shannon McKeown, Chicago, IL (US)

(72) Inventor: Shannon McKeown, Chicago, IL (US)

( * ) Notice: Subject to any disclaimer, the term of this patent is extended or adjusted under 35 U.S.C. 154(b) by 0 days.

(21) Appl. No.: 14/502,355

(22) Filed: Sep. 30, 2014

(51) Int. Cl.
*A44B 19/00* (2006.01)
*A47G 25/90* (2006.01)
*A44B 19/26* (2006.01)

(52) U.S. Cl.
CPC ..... *A47G 25/902* (2013.01); *A44B 19/262* (2013.01)

(58) Field of Classification Search
CPC ... B25J 15/0616; A47G 25/90; A47G 25/905; A47G 25/902; B65G 7/12; A45F 5/1026; A63B 55/007; B62J 7/08; A41F 1/00; A41F 17/02; B60P 7/0823; A47C 21/022; A44B 19/262
USPC ..... 294/3.6
See application file for complete search history.

(56) References Cited

U.S. PATENT DOCUMENTS

| | | | | | |
|---|---|---|---|---|---|
| 2,888,728 | A | | 6/1959 | Lebermann | |
| 2,908,057 | A | | 10/1959 | Blanco | |
| 2,974,991 | A | * | 3/1961 | Gerrick et al. | 294/3.6 |
| 3,201,839 | A | | 8/1965 | Reifsteck et al. | |
| 3,355,779 | A | * | 12/1967 | Hurst | 294/3.6 |
| 3,704,491 | A | | 12/1972 | Burgess | |
| D385,415 | S | * | 10/1997 | Turbide | D3/207 |
| 5,741,035 | A | * | 4/1998 | Glass | 294/25 |
| 5,855,401 | A | | 1/1999 | Papernik | |
| D405,028 | S | | 2/1999 | Papernik | |
| 6,112,958 | A | | 9/2000 | LaMacchia et al. | |
| D477,709 | S | * | 7/2003 | Natividad | D3/218 |
| D515,410 | S | * | 2/2006 | Tracy | D8/395 |
| 8,533,918 | B1 | | 9/2013 | Ketter et al. | |
| 8,910,983 | B1 | * | 12/2014 | Neff | 294/3.6 |
| 2012/0169076 | A1 | | 7/2012 | Brake et al. | |

* cited by examiner

*Primary Examiner* — Stephen Vu

(74) *Attorney, Agent, or Firm* — Levenfeld Pearlstein, LLC

(57) ABSTRACT

A zipper assist device for attaching to a zipper slider includes a first clasp formed as a dual-ended clasp that has a first clasp part configured to attach to the slider, and a second clasp part operably attached to the first clasp. A tether has an elongated flexible element and a third clasp part mounted to a first end of the tether. The third clasp part is engageable with the second clasp part of the first clasp. The zipper can be pulled up (zipped) or pulled down (unzipped) by the tether. The tether can be readily attached to and separated from the first clasp part.

13 Claims, 3 Drawing Sheets

--REPLACEMENT SHEET--

ZIPPER ASSIST DEVICE

BACKGROUND

Zippers are an everyday fact of life and are present in all manner of clothing. For the most part, zippers are readily accessible, for example, on the front of coats and jackets and the fly of pants and slacks. Zippers are also used in less readily accessible areas on the back of clothing, such as on the back of women's dresses and the back of costumes.

Zipper assist devices are known. Some devices use a soft tether, such as a string or rope attached to a hook that is in turn attached to a pull tab on the zipper slider. Other known assist devices use a rigid rod, also attached to the pull tab. These devices preclude the need to reach from the bottom of one's back to one's neck or shoulder when opening or closing the zipper.

While such devices are to an extent useful, they require engagement with and disengagement from the zipper pull tab. Some of the known devices use an open hook to engage the pull tab, while others use a fastener that requires considerable manipulation (and perhaps the ability to see) the fastener as it is engaged with and disengaged from the pull tab.

Moreover, there are problems associated with how and/or where to store such an assist device. If, for example, it is removed from the garment after closing the zipper, then the wearer must return to wherever the device is stored or carry the device with him or her in order to reuse it (reattach the device to open the zipper).

Accordingly, there is a need for a zipper assist device that is readily engaged with and disengaged from (or attached to and removed from) a zipper slider. Desirably, such a device is engaged with and disengaged from the slider with minimal manipulation and without requiring visually examining the device. More desirably still, such a device allows the user to maintain the device with him or her between uses.

SUMMARY

A zipper assist device for attaching to a zipper slider includes a first clasp formed as a dual-ended clasp that has a first clasp part configured to attach to slider, and a second clasp part operably attached to the first clasp part. A tether has an elongated flexible element and a third clasp part mounted to a first end of the tether. The third clasp part is engageable with the first clasp. The zipper can be pulled up (zipped) or pulled down (unzipped) by the tether. The third clasp part can be engageable with the second clasp part of the first clasp.

For purposes of the present disclosure, it is to be understood that while reference is made to attaching the present zipper assist device to a zipper slider, the zipper assist device may be attached directly to the slider, to the slider pull tab or to any other portion of the slider as will be appreciated from the present disclosure and the appended figures.

In an embodiment, a fourth clasp part is positioned at a second end of the tether, opposite the first end. The fourth clasp part can be engaged with the third clasp part to form a necklace independent of the first clasp. In an embodiment, the fourth clasp part can be engaged with the first clasp or the zipper slider, to also form a necklace, which necklace is engaged directly or indirectly with the zipper slider.

The first and second clasp parts can be operably connected to each other by one or more links, or they can be fixedly, e.g., rigidly mounted to each other.

In an embodiment, the first clasp part is a lobster-claw clasp and the second and third clasp parts form a barrel clasp. A pin, such as a brooch can be engageable with a second end of the tether, opposite the first end, to secure the second end of the tether to a wearer's clothing. The pin or brooch can be configured to secure the fourth clasp part to the wearer's clothing. In addition, the tether can be removed and worn independently, as a necklace, a bracelet, an anklet or the like.

The present zipper assist device provides numerous advantages over known devices. For example, the tether can be readily attached to and removed from the zipper slider without the need for a mirror or the like. Because the first part of the dual-ended clasp positively secures to the zipper slider such as by a clasp, it will remain secured to the slider until it is removed by the wearer. And, the ability to join the clasp parts on the tether around the user's neck to form a necklace and the ability to pin the brooch with the tether to a wearer's clothing allows for retaining the device on the user and function as further ornamentation while being readily available for use at any time.

These and other features and advantages of the present invention will be apparent from the following detailed description, in conjunction with the appended claims.

BRIEF DESCRIPTION OF DRAWINGS

The benefits and advantages of the present device will become more readily apparent to those of ordinary skill in the relevant art after reviewing the following detailed description and accompanying drawings, wherein.

DETAILED DESCRIPTION

Figure 1:
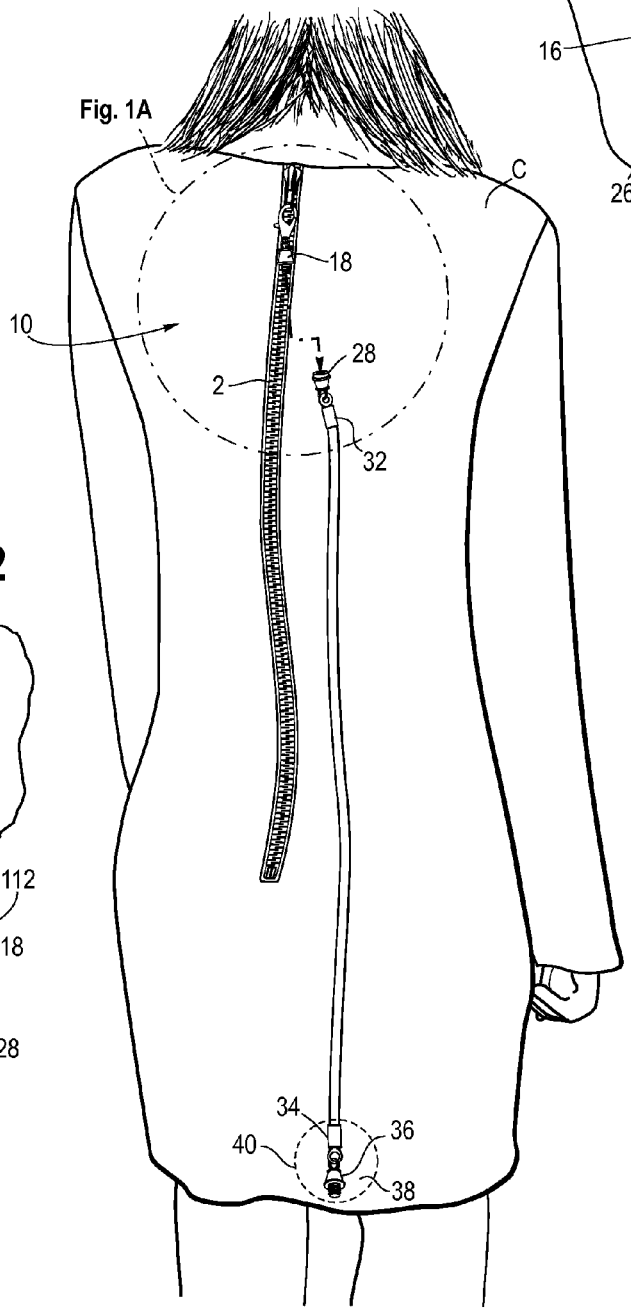
FIG. 1 is a rear view of a person in a dress with a zipper, showing an embodiment of a zipper assist device removed from the slider on the zipper.

While the present device is susceptible of embodiment in various forms, there is shown in the drawings and will hereinafter be described one or more presently preferred embodiments with the understanding that the present disclosure is to be considered an exemplification of the device and is not intended to limit the disclosure to the specific embodiment or embodiments illustrated.

As noted above, for purposes of the present disclosure, it is to be understood that while reference is made to attaching the present zipper assist device to a zipper slider, the zipper assist device may be attached directly to the slider, to the slider pull tab or to any other portion of the slider as will be appreciated from the present disclosure and the appended figures.

Figure 1A:
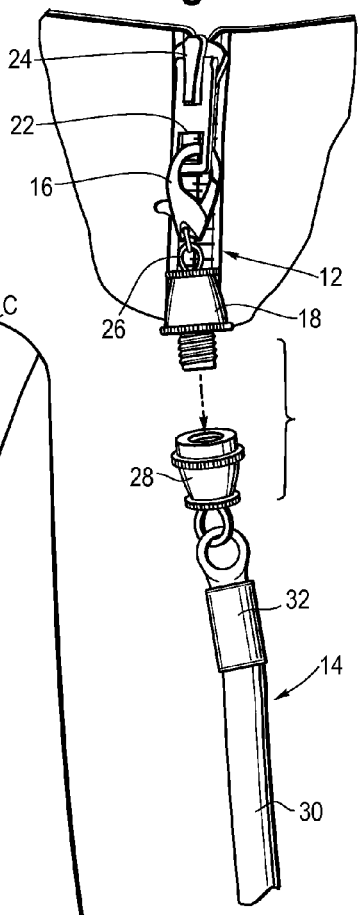
FIG. 1A is enlarged view of the region shown in FIG. 1, showing a dual-ended clasp mounted to the zipper slider FIG. 1 and showing in an exploded view, the tether attachment disengaged from the dual-ended clasp.
Figure 2:
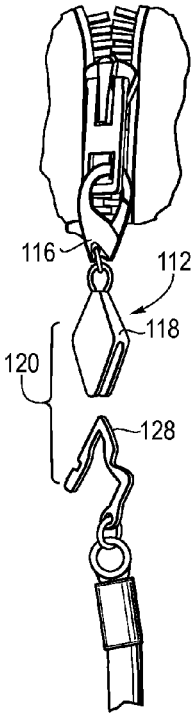
FIG. 2 illustrates an alternate type of clasp for use with the dual-ended clasp.
Figure 2A:
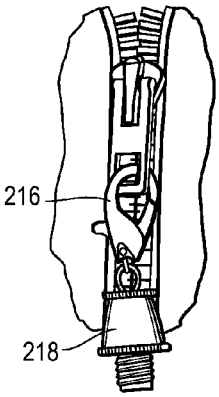
FIG. 2A illustrates another alternate type of clasp for use with the dual-ended clasp.
Figure 3:
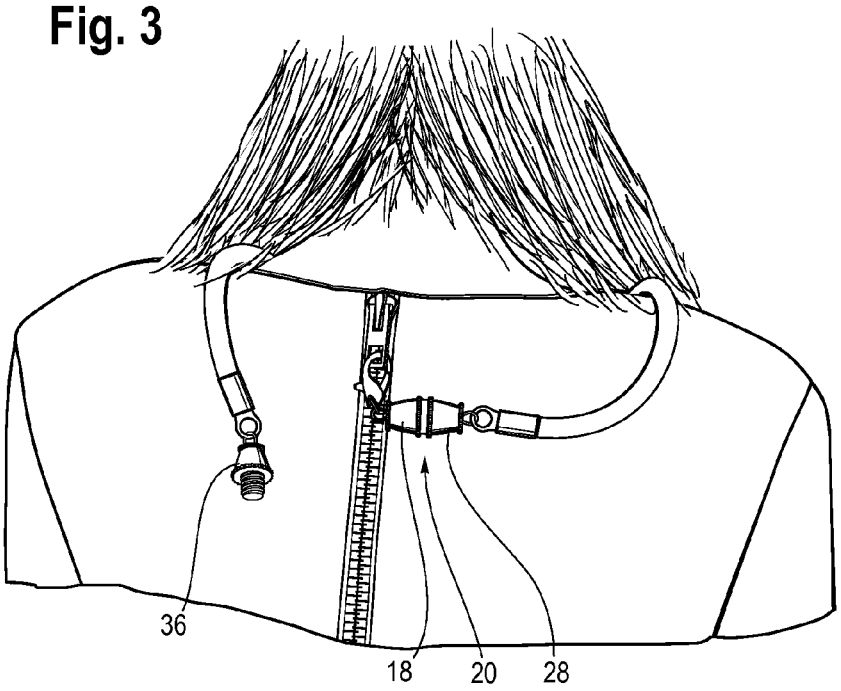
FIG. 3 illustrates the zipper assist device with one end mounted to the pull tab of a slider on the zipper and a second end free.
Figure 4:
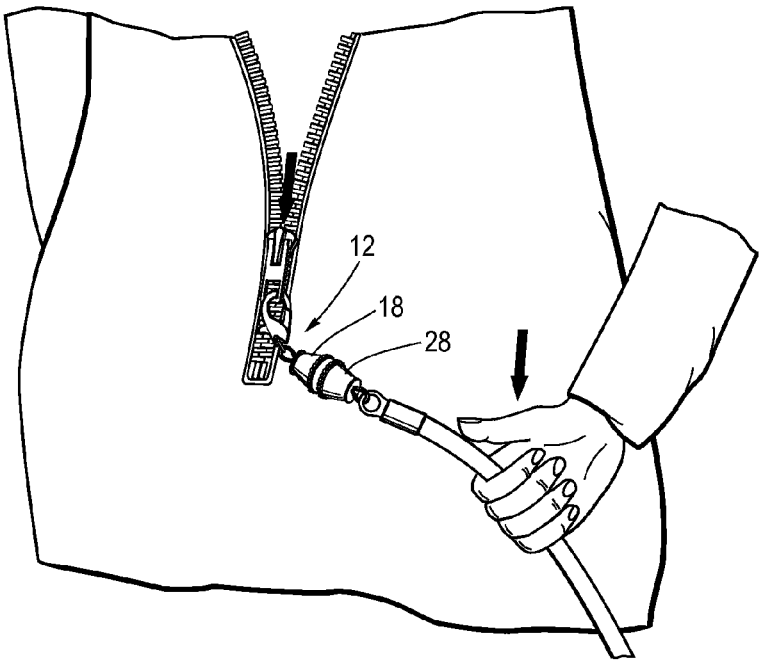
FIG. 4 shows the zipper assist device used to unzip the zipper.

Referring first briefly to FIG. 1A there is shown a zipper assist device 10. The device 10 includes, generally, a dual-ended clasp 12 and a tether 14. The embodiment of the dual-ended clasp 12 shown in FIG. 1 has a first clasp portion 16 formed as a lobster-claw type clasp and a second clasp portion 18 that is part of a two-part clasp, shown generally at 20 in FIG. 3. The illustrated two-part clasp 20 is formed, in part, as one part of a barrel- or twist-type clasp. As best seen in FIG. 1A, the lobster-claw portion 16 is configured to secure to the slider 24 of a zipper. In the illustrated embodiment, the zipper assist device 10 is mounted to the pull tab 22 of a zipper slider 24. In the embodiment of FIGS. 1 and 1A, the lobster-claw clasp 16 is joined to the barrel clasp part 18 by one or more loops or links 26. Other types of clasps can be used. As shown in FIG. 2, a second clasp portion 118 can be configured as part of a box clasp 112 (also a two-part clasp 120) that is joined to the first clasp portion 116 or as illustrated the lobster-claw clasp. Alternately still, as shown in FIG. 2A, the first clasp portion 216 and the second clasp portion 218 can be formed as an integral or integrated member, with an end of the lobster-claw portion 216 joined directed to an end of the barrel portion 218.

It will be appreciated that the barrel-type clasp and the box type clasp have two parts (for example, barrel parts 18, 28) that engage one another. In the barrel-type clasp the male part 18 and a female part 28 threadedly engage one another and in the fish-hook type clasp 120 a hook part 128 engages a body part 118) to lock the two parts 118, 128 together. Other types of two-part clasps are known and are within the scope and spirit of the present disclosure.

The tether 14 includes an elongated flexible element 30 such as a cord, chain or the like. Other suitable tethers will be recognized by those skilled in the art. A first end 32 of the tether 14 includes the clasp part 28 that is configured to engage the clasp part 18 of the two-part clasp 20 on the dual ended clasp 12.

For example, as seen in FIGS. 1 and 1A, the barrel clasp part 28 on the first end 32 of the tether 14 is configured to engage the barrel clasp part 18 on the dual ended clasp 12. In this manner, the tether 14 can be joined to and removed from the two-part clasp 20 of the dual-ended clasp 12.

A second end 34 of the tether 14 also includes one part 36 of the two part clasp 20. As seen in FIG. 1, the second end 34 of the tether 14 includes a clasp part 36, such as a barrel clasp part that is configured to engage the clasp part 28 on the first end 32 of the tether 14. As such, the tether ends 32, 34 can be joined to one another around the wearer's neck to form, for example, a necklace N.

Optionally, as seen in FIG. 1, the free end or second end 34 of the tether 14 can include a brooch 38, pin or other type of accessory item. The brooch 38 can be affixed to the second end 34 of the tether 14 and can include a pin 40 or the like to affix the brooch 38 to the user's clothing C.

Figure 5:
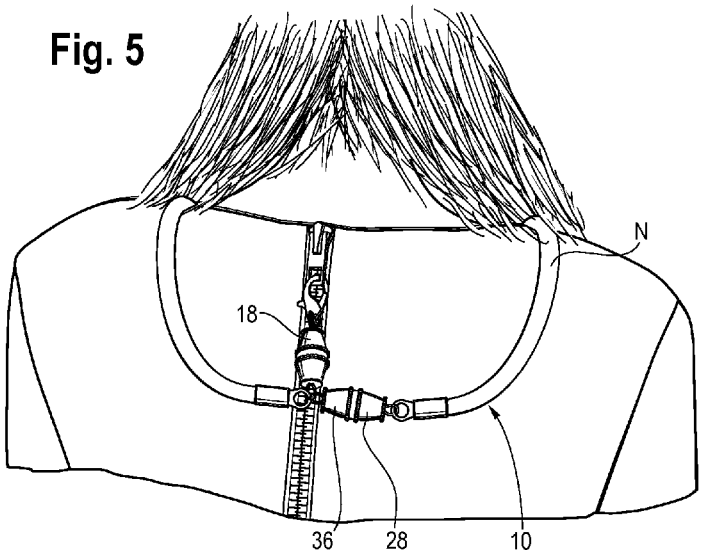
FIG. 5 shows the zipper assist device with the first end for the dual-ended clasp removed from the zipper slider and joined to the free end clasp with the tether positioned around the user's neck as, for example, a necklace.

It will be appreciated that the present zipper assist device 10 can be used in a multitude of ways. The tether 14 can simply be attached to the dual-ended clasp 12 to pull up or down, e.g., to zip or unzip, the zipper Z and then removed from the zipper Z by disengaging clasp parts 18 and 28. Alternately, after for example, zipping a dress, the clasp part 28 on the tether 14 can be removed from clasp part 18 of the two-part clasp 20 and the clasp parts 28 and 36 on the tether 14 can be joined around the user's neck to form a necklace N (see, FIG. 5), around the user's wrist to form a bracelet, around the user's ankle to form an anklet, or in a variety of other ways. In such a use, when the tether 14 includes the brooch 38, the necklace N forms part of the overall look and the brooch 38 can be worn as a simple hanging ornament on the necklace N formed from the tether 14. Alternately still, the first end 32 of the tether 14 can remain engaged with the dual-ended clasp 12, brought over the wearer's shoulder, and the brooch 38 (attached to the second end 34 of the tether 14) can be pinned to the user's clothing C as another type of ornamentation. Other uses of the tether will be recognized by those skilled in the art and are within the scope and spirit of the present disclosure.

Figure 6:
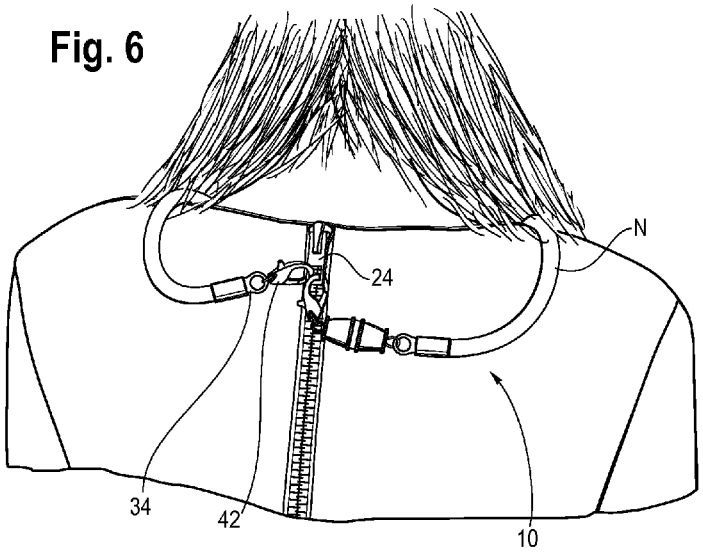
FIG. 6 illustrates another embodiment of the zipper assist device.

In still another use, as seen in FIG. 6, the zipper assist device 10 includes an optional clasp portion 42 on the free end 34 that allows the free end 34 to be fastened to the dual-ended clasp 12 or the zipper slider 24 to form a necklace N without disengaging clasp part 28 from clasp part 18. In such an embodiment, the necklace N is engaged directly or indirectly with the zipper slider 24. In this manner, the necklace N can be formed without disengaging the device 10 from the zipper Z, so that the assist function can be readily used, by disengaging the optional clasp portion 42 from the zipper slider 24.

It will be appreciated that the present zipper assist device 10 has a number of advantages over known devices. First, the tether 14 can be readily attached to and removed from the zipper pull tab 22 (from the dual-ended clasp 12), without the need for a mirror or the like, whether zipping or unzipping the zipper Z, because one part of the device 10, for example, the dual-ended clasp 12, remains on the zipper slider and can be readily engaged with, separated from, and reengaged with the second part 28 of the clasp by feel alone.

Moreover, because the first part 16 of the dual-ended clasp positively secures to the zipper slider 24 (by the clasp 16 rather than, for example a simple hook), it will remain secured to the slider 24 and will not inadvertently fall from the tab 22, and can be removed only when desired by the user.

In addition, the ability to join the clasp parts 28, 36 on the tether 14 around the user's neck to form a necklace N, the ability to pin the brooch 38 with the second end 34 of the tether 14 to a wearer's clothing C allows for retaining the zipper assist device 10 on the user and have the tether 14 function as further ornamentation while being readily available for use at any time, and the ability to join the optional clasp part 42 to the dual-ended clasp 12 or the zipper Z, to form a necklace N with an end 32 remaining directly or indirectly attached to the zipper Z are all readily appreciated.

Those skilled in the art and those of creative endeavors will appreciate the various ways in which the present zipper assist device can be used. All such variations are within the scope and spirit of the present disclosure.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover by the appended claims all such modifications as fall within the scope of the claims.

What is claimed is:

1. A zipper assist device for attaching to a zipper slider, the device comprising:

a first clasp, the first clasp being a dual-ended clasp and having a first clasp part configured to attach to the zipper slider, and a second clasp part operably attached to the first clasp part, the first and second clasp parts being disengageable from, and reengageable with each other;

a third clasp part engageable with the second clasp part; and a tether, the tether having an elongated flexible element and mounted to the third clasp part.

2. The device of claim 1 including a fourth clasp part at a second end of the tether, opposite the first end.

3. The device of claim 2, wherein the fourth clasp part is engageable with the third clasp part.

4. The device of claim 3 wherein the third and fourth clasp parts are engageable with one another to form a necklace independent of the first clasp.

5. The device of claim 2 wherein the fourth clasp part is engageable with first clasp part or the zipper slider.

6. The device of claim 5 wherein the fourth clasp part is engageable with the first clasp, the third clasp part or the zipper slider to form a necklace engaged with the zipper slider.

7. The device of claim 1 wherein the first and second clasp parts are operably connected to each other by one or more links.

8. The device of claim 1 wherein the first and second clasp parts are fixedly mounted to each other.

9. The device of claim 1 wherein the second and third clasp parts form a barrel clasp.

10. The device of claim 1 wherein the first clasp part is a lobster-claw clasp.

11. The device of claim 1 including a pin engageable with a second end of the tether, opposite the first end, the pin securing a second end of the tether and configured to secure to a wearer's clothing.

12. The device of claim 11 including a fourth clasp part at the second end of the tether, the fourth clasp part engageable with the third clasp part, the fourth clasp part operably mounted to the pin for securing the fourth clasp part to the wearer's clothing.

13. The device of claim 1 wherein the first clasp part is configured to remain attached to the zipper slider and the second clasp part is detachably attached to the first clasp part to separate the first and second clasp parts and wherein the third clasp part can be detachably attached to the second clasp.

* * * * *